US007284663B2

(12) United States Patent
Madigan

(10) Patent No.: US 7,284,663 B2
(45) Date of Patent: Oct. 23, 2007

(54) BOX CARD

(76) Inventor: Eric M. Madigan, 10000 Riverside Dr., Toluca Lake, CA (US) 91602

( * ) Notice: Subject to any disclaimer, the term of this patent is extended or adjusted under 35 U.S.C. 154(b) by 449 days.

(21) Appl. No.: 10/873,985

(22) Filed: Jun. 21, 2004

(65) Prior Publication Data

US 2005/0000854 A1 Jan. 6, 2005

Related U.S. Application Data

(60) Provisional application No. 60/480,317, filed on Jun. 23, 2003.

(51) Int. Cl.
*B65D 25/64* (2006.01)

(52) U.S. Cl. ..... 206/782; 206/775; 40/124.14

(58) Field of Classification Search ..... 40/124.08, 40/124.09, 124.14, 124.16; 206/763, 769, 206/775, 782, 776
See application file for complete search history.

(56) References Cited

U.S. PATENT DOCUMENTS 2,203,578 A 6/1940 Podmore
4,885,859 A 12/1989 Gasser
5,259,133 A 11/1993 Burtch
5,317,823 A 6/1994 Brunt, II
5,386,656 A 2/1995 Bergman
5,564,208 A 10/1996 Bergman
5,575,094 A * 11/1996 Leake et al. ..... 40/124.09
6,163,991 A 12/2000 Drapcho et al.
6,173,515 B1 1/2001 Walsh
6,386,370 B1 5/2002 Wigton et al.
6,536,145 B2 3/2003 Burtch et al.
6,758,340 B1 * 7/2004 Feibelman ..... 206/775

* cited by examiner

*Primary Examiner*—David T. Fidei
(74) *Attorney, Agent, or Firm*—Paul M Denk

(57) ABSTRACT

A box card cut from a singular blank, including a series of panels, all foldably linked together, select of the panels providing the front and back panels for the card, with intermediate panels provided for arrangement therein. Select of the front and initial panels are die cut and apertured, while the back panel provides a back wall for the device, and the last intermediate panel has a die cut display wall, which can be either imprinted in full, to provide a display, or be silhouette cut, to depict certain images, whether it be celebrities, sport stars, scenic areas, or the like, and the card is readily available for erection and display, by the purchaser.

6 Claims, 2 Drawing Sheets

BOX CARD

CROSS REFERENCE TO RELATED APPLICATION

This non provisional patent application claims priority to the provisional patent application having Ser. No. 60/480,317, which was filed on Jun. 23, 2003.

BACKGROUND OF THE INVENTION

This invention relates principally to a box card, or a fold up type of card that forms a shadowbox like design, integrally structured from a single blank, and which can be folded into a box like design, from the collapsed form, for displaying pictures or silhouettes for amusement or other purposes. Essentially, a part of this invention can be collapsed, and marketed through promotional programs as, for example, as an insert into a food carton or cereal box, or they may be marketed in packs, directly, at amusement parks, sporting events, or the like.

Various types of display cards or mailing cards have been available in the art. For example, in the United States patent to Podomore, U.S. Pat. No. 2,203,578, therein is shown a mailing card. This is an old style of mailing card that can be erected into a shadow box, as noted, and has a covering overlying the same which can be folded into closure, as when mailed.

The patent Gasser, U.S. Pat. No. 4,885,859, shows another folding card. This particular device does disclose a series of elements, incorporating central apertures therein and which are formed and identified as windows. Each one of the windows appears to be smaller in dimension from the succeeding one, and on the back panel, print material may be provided, to form a shadow box type of design, as noted. The device also incorporates a cover, which connects with its back panel, for providing coverage for the card, when folded.

The patent Burtch, U.S. Pat. No. 5,259,133, discloses a pop-up display device.

The patent Brunt, II, U.S. Pat. No. 5,317,823, shows another three-dimensional pop-up display and method for making the same. In this particular three-dimensional display, it includes its various display portions, and also has an internal hinge to the support member, for holding it in an open position.

The patent to Bergman, U.S. Pat. No. 5,386,656, shows a play card. This play card, as explained, generally erects into a format, which incorporates a variety of specially designed sections and that erect into the design that displays independent figures, when unfolded.

The patent to Bergman, U.S. Pat. No. 5,564,208, shows a related play card, and defines the various sections, such as it central section, with various connector panel, and a base structure, when which unfolded, forms the type of upright configuration as shown therein.

The patent to Drapcho, et al., U.S. Pat. No. 6,163,991, shows a machine-foldable display having superimposed, spaced-apart image panels. This particular machine-foldable display also incorporates a full set of various image panels, which when superimposed over each other, provide the type of display as can be seen in this patent.

The patent to Walsh, U.S. Pat. No. 6,173,515, shows a diorama card with pop-up configuration. The particular article as shown herein provides for various front and background panels, which when squeezed, extend into their arcuate configuration, with each member engaging with the background panel, to form the configured structure as shown in the diorama, as disclosed.

The patent to Wigton, et al., U.S. Pat. No. 6,386,370, shows a tiered shadowbox pop-up structure. This is collapsible pop-up structure, which incorporates its base sheet, and then includes an elongated panel, which is generally disclosed in the description. The elongated panel connects with a foundation panel, and which can be folded, along their fold lines, to provide for their pivoting towards or away from each other, as when the design is erected, or collapsed, as can be understood.

Finally, the patent to Burtch, et al., U.S. Pat. No. 6,536,145, shows an erectable display device with revealable inner panel.

These are examples of the prior art that exist relative to this current invention.

The current invention, though, incorporates other structure that forms a shadowbox, from a singular blank, having a display panel that is shiftable and pivotable approximate its back surface, which when erected, provides a rather three-dimensional view through the shadowbox towards the display panel, or which box can be collapsed, into a flattened configuration, to facilitate its storage or locating within another container, such as a cereal box, or the like.

SUMMARY OF THE INVENTION

This invention contemplates the formation of a box card, folded from a singular blank, and which can be erected into a shadowbox type of design, that can be manufactured, promoted, and marketed as a promotional item, a giveaway item, a novelty item, even a greeting card, during its usage.

Essentially, the box card of this invention is formed from a singular blank. The blank is die cut into a configuration that provides for a series of panels, that integrally includes a back panel, a front panel, that are connected by an intermediate top panel, a bottom panel, and then has internally but integrally folded within its interior additional panels that form openings through which viewing of a hingedly or pivotally connected rearward integral panel, and upon which various graphics may be displayed. Hence, the blank of this invention is folded into its usable configuration, and since the positioning of the various panels are generally in a parallel arrangement, with respect to each other, which includes the back panel, the aperture front panel, and intermediate opened panels, and the panel incorporating the display panel, the entire card can be folded and collapsed into a flattened configuration, to substantially reduce its depth. But, by simply pressing upon the top and bottom panels, the card can be expanded, displace the various panels with respect to each other, to provide for its erection, so that the box card and the box configuration can be stood on end, and the display panel readily viewed through the various aperture panels arranged forwardly thereof.

Essentially, the blank of this invention incorporates a bottom panel, a front panel pivotally connected thereto, as along a score or fold line, the front panel has significant height relative to the bottom panel, and is apertured to allow for direct viewing therethrough. In addition, a top panel pivotally connects to the upper end of the front panel, and folds perpendicularly relative thereto, and extends to a pivotally connected back panel, integrally formed therewith, so that the back may be folded downwardly, when the card is assembled. The back panel includes a spacer panel at its bottom, which extends forwardly for forming the rear viewing panel within the box structure. It is this rear viewing panel that incorporates the display panel, upon which a picture, display, design, silhouette or other indicia may be imprinted, even in the graphic, holographic, or other printed form, to provide for a three-dimensional type appearance to the display of this panel when viewed through the other aperture panels arranged forwardly thereof. The upper end of the rear panel incorporates another spacer panel, that adhesively connects to the interior of the top panel, approximately centrally thereof, and the intermediate panel integrally connects and provides for an extension downwardly of a second intermediate panel, forwardly thereof, and which also is apertured, so as to provide for a viewing area through which one may look, to see the imprinted panel, within the box structure, when it is erected. The intermediate apertured panel includes a further spacer panel, at its downward end, which may folded perpendicularly and rearwardly therefrom, or perhaps forwardly therefrom, and adhesively applied thereto to the interior of the bottom panel, so that all of the various panels of the card, when assembled from the blank form, all relatively spaced from each other, when the box card is erected into the box form, for viewing. Or, when the box card is collapsed, into the flattened configuration, all of these various panels become arranged in contiguity with each other, provide for a flattened configuration for the box card, to facilitate its insertion into another carton, into a card pack, or when stored or shipped for marketing.

The relative size of the box card may be to any dimensions, depending upon the needs and desires of the user, when marketing such a box card to the trade.

It is therefore, the principal object of this invention to provide a box card, of a shadowbox type design, which can be erected into the box configuration to provide for viewing of a display panel therein.

Another object of this invention is to provide a box card that may be collapsed into a flattened configuration, to reduce its substantial size and dimensions, until usage.

Still another object of this invention is to provide a box card that is formed from a singular blank, which integrally is formed from a variety of panels, into the box card configuration of this invention.

Still another object of this invention is to provide a swingable, pivotal, or moveable type of display panel that inserts and is integrally formed within one of the back panels of the shadowbox design, and which can be shipped in the flattened configuration in preparation for erection, installation, and usage.

Still another object of this invention is to provide a singularly formed box card, which may be collapsed, and stacked with a variety of such additional box cards, for use as promotional items in the marketing of pictures or displays of athletes, characters, Hollywood type stars, or even for educational or other purposes, to the trade.

Still another object of this invention is to provide a box card wherein a panel formed rearwardly in the structure of the box may be silhouette cut to provide a display for image of a person, object, animal, or the like.

Yet another object of this invention is to provide a four layer, three-dimensional self-standing collector card, which may be marketed as a multiple application product, i.e., for showing sports figures, sporting events, movies, entertainment, as well as an assortment of other promotional applications.

Yet another object of this invention is to provide a box card where its display panel may be imprinted with a holographic design, to add to the three-dimensional aesthetics of the box card when erected for display.

These and other objects may become more apparent to those skilled in the art upon review of the summary of this invention, and upon undertaking a study of the description of its preferred embodiment, in view of the drawings.

DESCRIPTION OF THE PREFERRED EMBODIMENT

Figure 1:
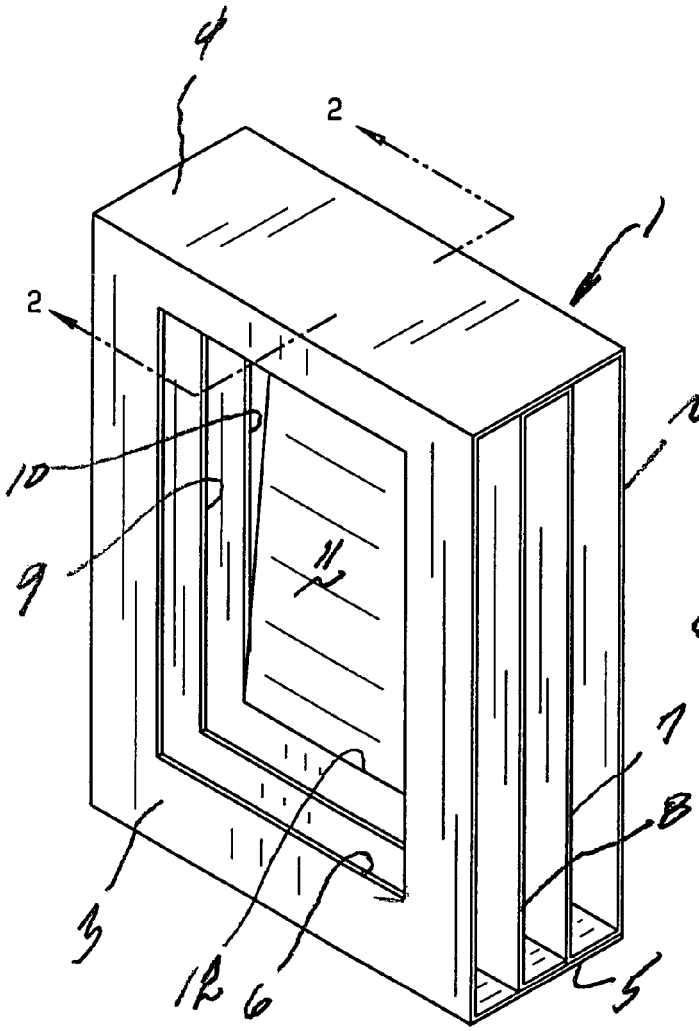
FIG. 1 is an isometric view of the box card of this invention.

In referring to the drawings, and in particular FIG. 1, therein is shown box card 1 of this invention. The card essentially includes a series of walls, such as a back panel 2, a front panel 3, a top panel 4, and a bottom panel 5. It is to be noted, the front panel 3 has an opening, as at 6, provide therethrough. A series of intermediate panels 7 and 8 are also provided. The intermediate panel 8, in addition to any other panels of such structure, further include apertured openings, as at 9, to provide viewing through the box card, in the manner of a shadowbox.

The intermediate panel 7 also includes a partial opening, as at 10, but the cut portion of the panel, providing a display wall 11 remains hinged, as along its hinge line 12, to the bottom portion of the intermediate panel 7, as can be noted. Obviously, while the hinge line is shown at 12, this could also be included along either a side edge, on one or the other side of the opening 10, or the wall can be hinged at its top edge, as can be understood.

Figure 2:
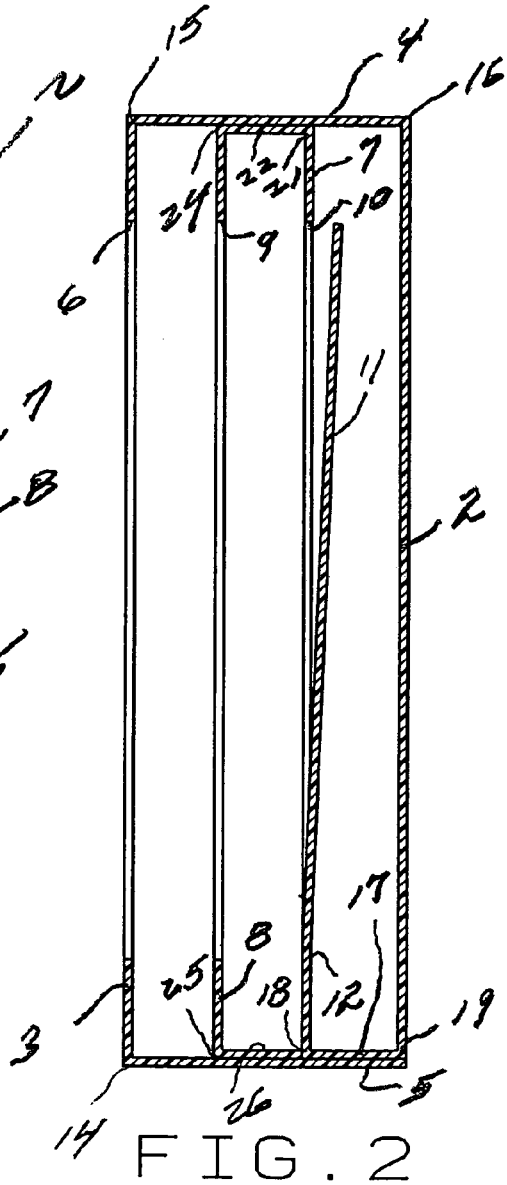
FIG. 2 is a sectional view taken along the line 2-2 of FIG. 1.
Figure 3:
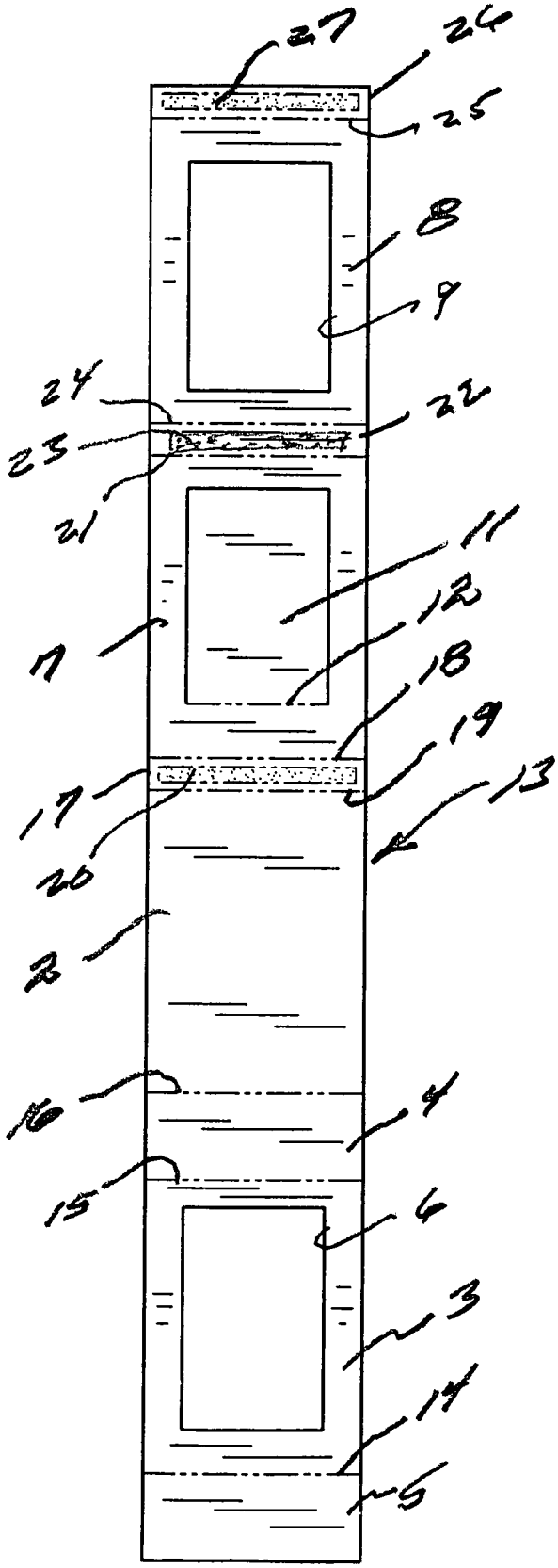
FIG. 3 is a plan view of the blank for the box card of this invention as integrally formed from a singular blank, to incorporate the variety of panels which may be erected into the box configuration, as noted.

Essentially, as can be seen in FIG. 2, the box card of this invention is fabricated from an integral blank. The entire blank is shown in FIG. 3, as at 13. Essentially, all of the various panels as previously described are integrally formed together, and separated by a series of fold lines. For example, the bottom panel 5 can be noted. The front panel 3, with its apertured portion 6, foldably connects along the score or fold line 14, as can be seen. The top panel 4 foldably connects along its fold line 15, to the front panel 3. A fold line 16 connects the back panel 2 to the top panel 4. A spacer panel 17 foldably connects between the back panel 2, and the back intermediate panel 7, by means of a pair of fold lines 18 and 19, respectively. As can further be noted, there is an adhesive means, comprising any type of glue, or other adhesive, as at 20, and this provides for tacking of the spacer panel 17 to the upper side of the bottom panel 5, as can be seen in FIG. 2. In addition, the back intermediate panel 7 connects by a fold line 21 to another spacer panel 22, in addition, this spacer panel 22 further includes an adhesive means 23, for tacking the spacer panel to the upper interior surface, approximate its midpoint, of the top panel 4, as to be noted in FIG. 2. In addition, the spacer panel 22 connects by a fold line 24 to the additional intermediate panel 8, and the panel 8 includes its apertured cutout portion 9, as noted. In addition, the intermediate panel 8 connects by the fold line 25, and an additional spacer 26, which further includes an adhesive means 27 for adherence to the interior surface of the bottom panel 5, as can be seen in FIG. 2.

The panel 7 includes a display wall 11, as can be noted, and this display wall connects either by fold line, or simply through integral connection, to the approximate bottom of the intermediate panel 7, as noted at 12. Thus, when the box card is fully assembled, the back wall 11 is free to be moved, having a display of indicia provided thereon, or even cut into a silhouette configuration, and can provide for a slight animation to the box card, when it has been fully assembled, and set up in a manner of a shadowbox, as can be understood. In addition, if the display provided upon the display wall 11 is of a holographic nature, slight movement adds to the depth perception of the box card, during its usage and display.

The interconnection between the various panels and walls that form the box card of this invention are more apply described and shown with respect to the cross-sectional view provided in FIG. 2. As can be seen, all of the panels are continuously folded from the integral blank 13, in the manner as described. As can be further understood, obviously, more or less of the intermediate panels may be provided, and will still provide for their integration into the structure of the box card, when assembled. Furthermore, for the box card shown in FIG. 2, when it is urged into a collapsed configuration, where the various panels lie contiguously one upon the other, it is fully flattened, and thereby allows for their shipment in bulk, and furthermore, allows for the insertion of the box card into a cereal box, or into a pack, to be marketed in this manner, using significantly reduced space under the circumstances.

In view of the description provided herein, of the preferred embodiment, it can be readily determined that the box card of this invention can be easily die cut from a singular blank of material, folded into its usable configuration, adhesively or otherwise tacked at certain locations to maintain its erected integrity, and then either be folded into its usable configuration as shown in FIG. 1, or it can be collapsed and flattened, for shipment, storage, or locating within a multiple pack, for marketing, or provided within a cereal box, or the like, as a giveaway and incentive item.

Variations and modifications to the subject matter of this invention may occur to those skilled in the art upon reviewing the disclosure as provided herein. Such variations, if within the concept of this development, are intended to be encompassed within the scope of the invention as shown and described. The description of the preferred embodiment and its depiction in the drawings are set forth for illustrative purposes only.

I claim:

1. A box, for viewing an item placed within said box, comprising:

a front panel having an opening;

a back panel opposite said front panel;

a top panel perpendicular to said front panel and to said back panel;

a bottom panel opposite said top panel;

two or more intermediate panels generally parallel to and disposed between said front panel and said back panel; the first of said intermediate panels located proximate to said back panel having a display wall adapted for placement of said item; and the second and latter of said intermediate panels having an opening of similar shape to the opening in said front panel;

said display wall detaches upon one or more edges from said first intermediate panel; and whereby a person places an item upon said display wall for viewing through said front panel and said second and latter intermediate panels.

2. The viewing box of claim 1 wherein said top panel is contiguous with said front panel and said back panel, and said bottom panel is contiguous with said front panel.

3. The viewing box of claim 1 wherein said display wall tilts upon a fold line proximate to said bottom panel and then towards said back panel.

4. The viewing box of claim 1 wherein said display wall, the opening in said front panel, the opening in the second and later of said intermediate panels, and said box have a generally rectangular shape.

5. A box, for viewing an item placed within said box assembled from a single blank, comprising:

a bottom panel, a front panel having an opening, said front panel contiguous with said bottom panel;

a top panel contiguous with said front panel and opposite said bottom panel;

a back panel contiguous with said top panel;

a first intermediate panel having a display wall scored upon two or more edges and a contiguous spacer panel upon a lateral end of said first intermediate panel; and a second intermediate panel having an opening of similar shape to the opening of said front panel and contiguous spacer panels upon both lateral ends of said second intermediate panel;

whereby, said second intermediate panel and said first intermediate panel fold in an alternating manner within said box and a person places an item upon said display wall for viewing through said front panel and said second and later intermediate panels.

6. The viewing box of claim 5 wherein said box and said openings are generally rectangular in shape.

* * * * *